US009050844B2

(12) United States Patent
Behrens et al.

(10) Patent No.: US 9,050,844 B2
(45) Date of Patent: Jun. 9, 2015

(54) HEAT-SENSITIVE RECORDING MATERIAL WITH BARRIER COATING

(75) Inventors: Ulf Behrens, Harrislee (DE); Gerhard Stork, Flensburg (DE); Svenja Eisernitz, Flensburg (DE); Matthias Marx, Nortorf (DE)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 335 days.

(21) Appl. No.: 13/512,979

(22) PCT Filed: Sep. 13, 2010

(86) PCT No.: PCT/EP2010/063412

§ 371 (c)(1),
(2), (4) Date: Oct. 9, 2012

(87) PCT Pub. No.: WO2011/067004

PCT Pub. Date: Jun. 9, 2011

(65) Prior Publication Data

US 2014/0274681 A1 Sep. 18, 2014

(30) Foreign Application Priority Data

Dec. 1, 2009 (EP) ..... 09177678

(51) Int. Cl.

| | |
|---|---|
| ***B41M 3/14*** | (2006.01) |
| ***B41M 5/327*** | (2006.01) |
| ***B41M 5/333*** | (2006.01) |
| ***B41M 5/337*** | (2006.01) |
| ***B41M 5/42*** | (2006.01) |
| ***B41M 5/44*** | (2006.01) |
| ***B41M 5/41*** | (2006.01) |
| *B41M 3/10* | (2006.01) |

(52) U.S. Cl.

CPC . *B41M 5/44* (2013.01); *B41M 3/10* (2013.01); *B41M 3/14* (2013.01); *B41M 5/3275* (2013.01); *B41M 5/3335* (2013.01); *B41M 5/3336* (2013.01); *B41M 5/3372* (2013.01); *B41M 5/3375* (2013.01); *B41M 5/41* (2013.01); *B41M 5/42* (2013.01); *B41M 5/423* (2013.01); *B41M 5/426* (2013.01); *B41M 2205/04* (2013.01); *B41M 2205/38* (2013.01); *B41M 2205/40* (2013.01)

(58) Field of Classification Search

CPC ..... B41M 3/10; B41M 3/14; B41M 5/3275; B41M 5/3336; B41M 5/3372; B41M 5/44; B41M 5/327; B41M 5/333; B41M 5/336; B41M 5/337; B41M 5/42

USPC ..... 503/200–226; 106/94, 96; 283/94, 96

See application file for complete search history.

(56) References Cited

U.S. PATENT DOCUMENTS

| | | | |
|---|---|---|---|
| 5,641,724 | A | 6/1997 | Yamaguchi et al. |
| 5,804,529 | A | 9/1998 | Komatsu |
| 6,150,067 | A | 11/2000 | Koike et al. |

*Primary Examiner* — Bruce H Hess

(74) *Attorney, Agent, or Firm* — Cozen O'Connor

(57) ABSTRACT

A heat-sensitive recording material includes at least a substrate, a heat-sensitive recording layer arranged on the front side of the substrate and has at least one color former and at least one color acceptor, wherein the color former and color acceptor react with one another under the action of heat to form color, a protective layer covering the heat-sensitive recording layer, a barrier coating which contains ethylene vinyl alcohol copolymer (EVOH) and suitable for protecting the heat-sensitive recording layer against penetration of chemicals causing uncontrolled desensitizing reactions and color reactions in the heat-sensitive recording layer, wherein the barrier coating is arranged between the substrate and the heat-sensitive recording layer, and a tincture, as authenticating security feature, introduced into the substrate and/or applied to at least one side of the substrate.

17 Claims, No Drawings

HEAT-SENSITIVE RECORDING MATERIAL WITH BARRIER COATING

PRIORITY CLAIM

This is a U.S. national stage of application No. PCT/EP2010/063412, filed on 13 Sep. 2010. Priority is claimed on European Application No.: 09177678.1, filed 1 Dec. 20096, the content of which is incorporated here by reference in their entirety.

BACKGROUND OF THE INVENTION

1. Field of the Invention

The invention is directed to a heat-sensitive recording material comprising a substrate having at least one heat-sensitive recording layer on the front side thereof, this heat-sensitive recording layer in turn having at least one dye precursor and at least one color acceptor which react with one another under the action of heat to form color. According to the invention, the heat-sensitive recording layer is covered by a protective layer. Further, the heat-sensitive recording material has a barrier coating which is capable of protecting the heat-sensitive recording layer against penetration into the substrate side of the heat-sensitive recording layer by chemicals which can cause uncontrolled desensitizing reactions and color reactions. These chemicals which can cause uncontrolled desensitizing reactions and color reactions in the heat-sensitive recording layer are possibly constituents of tinctures according to the invention which are introduced into the substrate and/or applied to at least one side of the substrate as an authenticating security feature.

2. Description of the Prior Art

A heat-sensitive recording material having a barrier coating within the material is known in principle, for example, from EP 0 938 419 B1. In this case, a coating applied to the back of the substrate of the known recording material has a mixture containing:

- starch,
- an acrylate copolymer which does not include any styrene components or vinyl acetate components and which has a film-forming temperature of less than 5° C., preferably less than 2° C.,
- and an alkaline catalyst, e.g., calcium carbonate.

The back-coating of the known heat-sensitive recording material is intended to ensure a good barrier effect against substances used in offset printing and flexographic printing, particularly organic solvents, and against plasticizers, oils and fats.

A heat-sensitive recording material of comparable construction is also known from EP 2 033 802 A1, according to which the recording material has a substrate to which is applied on the front side thereof a heat-sensitive recording layer covered by a protective layer and which has on the back side a backcoat which, in addition to pigments and binders, includes a polyurethane-based component acting as cross-linking agent.

Both of these heat-sensitive recording materials have proven to be of commercial merit and offer excellent solutions to the problem of a backcoat protecting against plasticizers, oils and fats. However, neither publication suggests a way to protect the heat-sensitive recording layer against chemicals which can cause either an unwanted color-forming reaction in the recording layer or fading or extinguishing of a printed image which is to be formed, or which is formed, in the recording layer, these chemicals—also in large amounts—being contained in the substrate and/or applied to at least one side of the substrate. Isolation of this problem was achieved after lengthy analysis of numerous defective products which made it necessary when formulating the problem to also put to the test the common basic processes for producing heat-sensitive recording materials.

In formulating a problem of this kind, the tightness of layers against organic solvents in particular plays a prominent role. Beyond this, the inventors realized after numerous preliminary tests that many of the known or obvious formulas for making a protective coating very often led to processing difficulties in handling during production due to rheological peculiarities of the coating compositions which are generally self-crosslinking. These processing difficulties lead particularly to coating defects because of excessively highly viscous coating composition constituents and to a gradual clogging in the pipelines to the coating units.

A composition of a heat-sensitive recording material approaching the aimed for solution to the problem described in the following is shown particularly in U.S. Pat. No. 5,804,529 A which provides for embedding a heat-sensitive recording layer between two layers based on polyvinyl alcohol or on ethylene vinyl alcohol copolymer (EVOH). Although the goal of this known suggestion is to provide a heat-sensitive recording material having excellent light fastness, while other effects of this known suggestion are not mentioned in the document, this suggestion, as the prior art coming closest, is particularly significant.

To the extent that they are technically comparable, the disclosures of U.S. Pat. No. 6,150,067 A should also be mentioned, whereas the disclosures of U.S. Pat. No. 5,641,724 A—a reversible heat-sensitive recording compound—only disclose remote prior art.

The documents evaluated thus far say nothing about security features possibly being provided in the heat-sensitive recording materials and consequently also nothing about problems occurring in this respect or how these problems may be solved.

In this regard, security features by which the genuineness of a recording material can be proved are made possible as proof of authenticity for documents in the form of passive inspection, for example, through watermarks. By watermark is meant, generally, a mark in the paper which is generated through different paper thicknesses. A distinction is made between true watermarks which are produced by displacement (so-called light watermarks) or by concentration (so-called shaded watermark) of the fiber pulp using, for example, a dandy roll in the wire section of a paper machine, impressed watermarks, also called Molette watermarks, which are produced by impressing the paper while still wet in the press section of a paper machine, and, finally, imitation watermarks which are made either by imprinting the finished paper outside the paper machine with a colorless varnish or by stamping the finished paper outside the paper machine.

Heat-sensitive recording materials with authenticating security features in the form of watermarks are generally known. For example, EP 0 844 097 A1 discloses, as first security feature for a heat-sensitive recording material in the form of an imitation watermark, a latent image which is imprinted on the back side of the recording material and is produced by a security ink containing a fluorescent reagent. The security ink contains a water-repelling agent to form a second security feature in the form of a waterproof image on the back side of the heat-sensitive recording material. The security ink containing the fluorescent reagent, which is used as pigment or dye, and the water-repelling agent is contained or dispersed in an aqueous carrier which, in addition to these components, can also contain a binder.

A disadvantage to this suggestion consists in that counterfeiting or copying can be accomplished fairly easily owing to what must really be characterized as a simply structured security ink. The reason for this simple structuring is that security inks having a complex structure are mostly poorly compatible with the chemical processes taking place during the formation of character images in the heat-sensitive recording layer; in the worst case, security inks of complex structure impede or even prevent these text-forming processes.

SUMMARY OF THE INVENTION

Based on the set of problems described above, the invention has the object of developing a heat-sensitive recording material having an authenticating security feature, which heat-sensitive recording material

- has a recording layer which
  - can form a print image brought about under the action of heat and which, in addition,
  - ideally has a broad spectrum of possible dye precursors and also a broad spectrum of color acceptors reacting with these dye precursors to form colors,
- can be produced economically,
- makes possible a reliable proof of authenticity,
- is flexible with respect to use which, within the meaning of the present invention, includes the possible use of a wide assortment of possible tinctures which can be employed as authenticating security feature.

In order to meet the objects stated above, a heat-sensitive recording material is provided which has at least a substrate, a heat-sensitive recording layer which is arranged on the front side of the substrate and which has at least one dye precursor and at least one color acceptor, wherein the dye precursor and color acceptor react with one another under the action of heat to form color, a protective layer covering the heat-sensitive recording layer, a barrier coating which contains an ethylene vinyl alcohol copolymer (EVOH) and is suitable for protecting the heat-sensitive recording layer against penetration of chemicals causing uncontrolled desensitizing reactions and color reactions in the heat-sensitive recording layer, wherein the barrier coating is arranged between the substrate and the heat-sensitive recording layer, characterized in that a tincture, as authenticating security feature, is introduced into the substrate and/or is applied to at least one side of the substrate.

Only a heat-sensitive recording material having the arrangement, according to the invention, of substrate with a tincture as authenticating security feature which is introduced into the substrate and/or is applied to at least one side of the substrate and of the at least necessary barrier coating, heat-sensitive recording layer and protective layer which are to be provided in the above sequence on the front side of the substrate, is capable of meeting the stated object of protecting the heat-sensitive recording layer over the long term from chemicals, as possible constituents of the tincture, which can cause either an unwanted color-forming reaction in the recording layer or fading or extinguishing of a print image which is to be formed, or which is formed, in the recording layer, and which chemicals are significantly contained in the substrate and/or applied to at least one side of the substrate, also in large amounts, after the authenticating safety feature is formed. The above-mentioned chemicals are intended primarily to be plasticizers and particularly organic solvents without being limited to this.

In the arrangement, according to the invention, of substrate and the at least necessary barrier coating, heat-sensitive recording layer and protective layer which are to be provided in the above sequence on the front side of the substrate, the heat-sensitive recording layer is shielded toward the substrate by the barrier coating containing the ethylene vinyl alcohol copolymer (EVOH); this barrier coating presents a perfect and particularly important permanent protection against chemicals of the tincture as authenticating security feature. The barrier coating containing ethylene vinyl alcohol copolymer (EVOH) is able to protect the heat-sensitive recording layer against even a long-lasting exposure to organic solvents as well as oils or fats—as possible examples for chemicals of the tincture—from the direction of the substrate.

Since the heat-sensitive recording material according to the invention is produced and subsequently stored in roll form, the front side and back side of the recording material come into contact in the roll. Due to the arrangement of a protective layer covering the heat-sensitive recording layer, the heat-sensitive recording layer is also shielded outwardly and toward the substrate of the next layer of a roll by the protective layer which is likewise to be formed in such a way that it provides good protection against the chemicals of the tincture as authenticating security feature.

A barrier coating based on ethylene vinyl alcohol copolymer turned out to have a particularly convincing superiority in various trials. On the one hand, compared to a coating based on conventional polyvinyl alcohol, a coating based on ethylene vinyl alcohol copolymer forms a substantially improved barrier effect, for example, against organic solvents and, above all, also against fats which particularly tend to migrate. On the other hand, if a barrier coating is formed, for example, based on high-molecular silanized polyvinyl alcohol, the very great processing difficulties relating to this silanized polyvinyl alcohol play a decisive role due, among others, to its high viscosity:

- if the high molecular weight polyvinyl alcohol highly diluted in water is selected in the coating composition for forming the barrier coating, processing thereof is certainly possible, but there is no satisfactory shielding of the heat-sensitive recording layer toward the substrate: exposure to chemicals from the tincture, for example, organic solvents, results in uncontrollable desensitizing reactions or color reactions in the heat-sensitive recording layer;
- if the aqueous dilution is reduced, the coating composition for forming the barrier coating becomes more and more viscous: there is a risk of coating defects which, in case of exposure to organic solvents or to oils or fats, leads once again to uncontrollable desensitizing reactions or color reactions in the heat-sensitive recording layer and/or to a gradual clogging of the pipe lines to the coating unit for forming the barrier coating.

The barrier coating of the heat-sensitive recording material according to the invention preferably comprises at least 90 percent by weight, particularly preferably at least 98 percent by weight, of ethylene vinyl alcohol copolymer based on the total weight of the barrier coating. Additional constituents of this barrier coating are, for example, defoaming agents and/or agents for stabilizing the ink curtain in the eventuality that the coating composition for the barrier coating is applied by means of curtain coaters or slide coaters.

The coating weight of the barrier coating is preferably in a range of 0.9 to 5.0 $g/m^2$, particularly preferably in a range of 1.5 to 3.5 $g/m^2$. Coating devices which are considered particularly suitable for applying this barrier coating are noncontacting coating apparatus such as air brushes, curtain coaters and slide coaters without limiting in any way to the latter.

In accordance with the statements made above in paragraphs [0014] and [0016], the formation of a protective layer covering the heat-sensitive recording layer is of integral importance for the invention. Besides a protective layer which, like the barrier coating, is produced on the basis of ethylene vinyl alcohol copolymer (EVOH) and which then preferably contains at least 90 percent by weight, particularly preferably at least 98 percent by weight, of the ethylene vinyl alcohol copolymer based in each instance on the total weight of a protective layer of this kind, it was also possible to achieve very good results with a protective layer having as binder at least 60 percent by weight, particularly preferably at least 85 percent by weight, of diacetone-modified polyvinyl alcohol based on the total binder component in the protective layer. A protective layer formed in this way is preferred within the meaning of the invention.

In a first possible embodiment, the above-mentioned preferred protective layer of the heat-sensitive recording material according to the invention can have, in addition to the diacetone-modified polyvinyl alcohol, additional binders, particularly mixtures of different carboxyl group-modified or silanol-modified polyvinyl alcohols. The latter then make up a maximum of 40 percent by weight, particularly preferably a maximum of only 15 percent by weight, based again on the total binder component in the protective layer. In a second possible embodiment, the protective layer of the heat-sensitive recording material according to the invention has exclusively diacetone-modified polyvinyl alcohol as binder. Particularly when diacetone-modified polyvinyl alcohol is the sole binder in the protective layer covering the heat-sensitive recording layer, it is particularly preferable when the proportion of binder in the protective layer is in a range from 35 to 65 percent by weight based on the total weight of the protective layer.

Cross-linking agents in the protective layer are particularly those selected from the following group: boric acid, polyamine, epoxy resin, dialdehyde, formaldehyde oligomers, epichlorohydrin resin, adipic acid dihydrazide, dimethyl urea, and melamine formaldehyde. Mixtures of different cross-linking agents are also possible.

The ratio of weight percent of binder, particularly diacetone-modified polyvinyl alcohol, to cross-linking agent in the protective layer preferably ranges from 20:1 to 5:1, and is particularly preferably in the range of 12:1 to 7:1.

Particularly good results were achieved when the protective layer additionally contained an inorganic pigment. It is especially recommended that the inorganic pigment is selected from the group including silicon dioxide, aluminum hydroxide, bentonite, calcium carbonate, kaolin, or a mixture of these inorganic pigments. In particular, a ratio of pigment—and in this case, particularly preferably kaolin—to diacetone-modified polyvinyl alcohol is adjusted within a range of 1:1.5 to 1:4.5 based on the respective weight percentage of pigment and polyvinyl alcohol in the protective layer.

Roll doctor coating units, knife coating units, curtain coaters or air brushes can be used in particular as coating equipment for applying the protective layer covering the heat-sensitive recording layer. The basis weight of the protective layer is preferably between 1.0 g/m$^2$ and 3.0 g/m$^2$ or, better still, between 1.6 g/m$^2$ and 2.3 g/m$^2$.

The composition of the heat-sensitive recording layer is less limited. In this respect, the inventors recognized with regard to the stated object that the recording layer can, first, as a matter of principle, contain all known dye precursors, combinations of more than one dye precursor also being possible.

In general, particularly at least one of the substances is selected from the following list as possible color acceptor:

2,2-bis(4-hydroxyphenyl)propan,

4-[(4-(1-methylethoxy)phenyl)sulfonyl]phenol, 4,4'-dihydroxydiphenyl sulfone,

N-(p-toluenesulphonyl)-N'-3-(p-toluenesulphonyloxyphenyl)urea, 2,4'-dihydroxydiphenyl sulfone, N-(2-hydroxyphenyl)-2-[(4-hydroxyphenyl)thio]acetamide, without in any way being limited to the color acceptors mentioned above.

In a first preferred embodiment according to this paragraph and the following paragraphs [0029] to [0032], the heat-sensitive recording layer has as color acceptor at least 33⅓ percent by weight, based on the total color acceptor component in the heat-sensitive recording layer, of N-(p-toluenesulphonyl)-N'-3-(p-toluenesulphonyloxyphenyl)urea according to the following formula (1), where the two $CH_3$ end molecules are often omitted in the literature:

Formula (1)

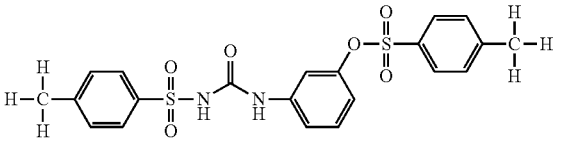

N-(p-toluenesulphonyl)-N'-3-(p-toluenesulphonyloxyphenyl)urea, according to Formula (1) above, is known as Pergafast® 201 by CIBA Speciality Chemicals Inc.

In this first embodiment, it is particularly preferable that N-(p-toluenesulphonyl)-N'-3-(p-toluenesulphonyloxyphenyl)urea according to Formula (1) is the sole color acceptor. Based on the total weight of the recording layer, the color acceptor then constitutes up to 32 percent by weight, but preferably a proportion in a range from 18 to 30 percent by weight, better yet between 20 and 28.5 percent by weight, of the heat-sensitive recording layer.

The recording layer of the heat-sensitive recording material according to the invention in this first embodiment can also preferably contain sensitizers in order to increase thermal responsiveness. Sensitizers of this kind are, first, the substances mentioned in paragraph [0040]; but 2-(2H-benzotriazol-2-yl)-p-cresol according to the following formula (2) is particularly preferred in this first embodiment, where the $CH_3$ end molecules is often omitted in the literature in this case also:

Formula (2)

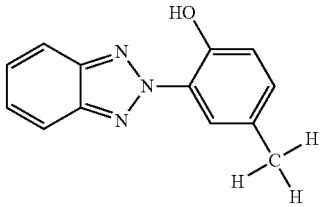

2-(2H-benzotriazol-2-yl)-p-cresol according to Formula (2), available as Tinuvin® from CIBA Speciality Chemicals Inc., can be used as the sole sensitizer or in combination with the sensitizers mentioned in paragraph [0040] in the recording layer of the recording material according to the invention.

In a second embodiment, likewise preferred, according to this paragraph and the following paragraphs [0034] to [0036]

and [0041], the heat-sensitive recording layer has, as color acceptor, at least 66⅔ percent by weight of 4,4'-dihydroxydiphenyl sulfone based on the total color acceptor component in the heat-sensitive recording layer.

4,4'-Dihydroxydiphenyl sulfone is also commonly called 4,4'-sulfonyldiphenol and is also known under the trade name 4,4 Bisphenol S. The empirical chemical formula of 4,4'-dihydroxydiphenyl sulfone is $C_{12}H_{10}O_4S$, which can be represented by the following formula (3):

Formula (3)

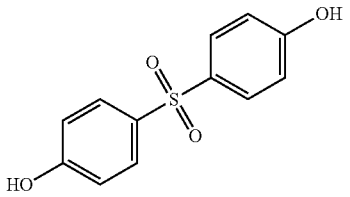

In addition to 4,4'-dihydroxydiphenyl sulfone, the heat-sensitive recording layer of the heat-sensitive recording material according to the invention in this second embodiment can have additional color acceptors selected from the list comprising:

2,2-bis(4-hydroxyphenyl)propan—also known as bisphenol A,

4-[(4-(1-methylethoxy)phenyl)sulfonyl]phenol—also known as D8, and

Pergafast® 201.

Preferably, a maximum of 10 percent by weight of the aforementioned color acceptors—based on the total color acceptor component in the heat-sensitive recording layer—are incorporated individually or in combination in this heat-sensitive recording layer, with 4,4'-dihydroxydiphenyl sulfone accounting for the remainder. Finally, in a particularly preferred embodiment form, 4,4'-dihydroxydiphenyl sulfone is the only color acceptor in the heat-sensitive recording layer.

As dye precursors or color formers in the heat-sensitive recording layer, the heat-sensitive recording material preferably has at least one substance selected from the list comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran. In this respect, 3-dibutylamino-6-methyl-7-anilinofluoran—also known as ODB-2—is particularly preferable.

It is possible for the heat-sensitive recording layer to have more than one dye precursor selected from the dye precursors listed in the preceding paragraph. But, in addition to these substances specified as dye precursors, the recording material according to the invention can also contain one or more of the following compounds which are absorbent in the near infrared range:

3,6-Bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(diethylamino)fluorene-9-spiro-3'-(6'-diethylaminophthalide), 3,6-bis-(dimethylamino)fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), 3,3-bis[2-(4-dimethylaminophenyl)-2-(4-methoxyphenyl)ethenyl]-4,5,6,7-tetrachlorophthalide.

To increase thermal responsiveness, the recording layer of the heat-sensitive recording material according to the invention can preferably also contain sensitizers, ideally with a melting point of 60° C. to 180° C., particularly preferably with a melting point of 80° C. to 140° C. Examples of sensitizers of this type are: benzyl-p-benzyloxybenzoate, methylolstearamide, stearic acid amide, p-benzylbiphenyl, 1,2-di(phenoxy)ethane, 1,2-di(m-methylphenoxy)ethane, m-terphenyl, dibenzyloxalate, benzyl naphthyl ether, dimethyl terephtalate, and diphenyl sulfone, most preferably methylolstearamide and, in particular, stearic acid amide and dimethyl terephtalate.

It has been shown in numerous tests for the second preferred embodiment form relating to the heat-sensitive recording layer that a ratio of color acceptor$_{total}$:sensitizer$_{total}$ and particularly 4,4'-dihydroxydiphenyl sulfone:sensitizer selected from the list comprising methylolstearamide, stearic acid amide, and dimethyl terephtalate based on weight percent in the recording layer is preferably in a range of 1:0.5 to 1:2 and particularly preferably in a range of 1:0.8 to 1:1.4.

Suitable binders for incorporating in the heat-sensitive recording layer are, for example, water-soluble binders such as starch, hydroxy ethyl cellulose, methyl cellulose, carboxy methyl cellulose, gelatins, casein, polyvinyl alcohols, modified polyvinyl alcohols, ethylene vinyl alcohol copolymers, sodium polyacrylates, acrylamide/acrylate copolymers, acrylamide/acrylate/methacrylate terpolymers, and alkali salts of styrene maleic acid anhydride copolymers or ethylene maleic acid anhydride copolymers, wherein the binders can be used alone or in combination with one another; also, water-insoluble latex binders such as styrene-butadiene copolymers, acryl nitrile butadiene copolymers, and methyl acrylate butadiene copolymers can be used as binders for incorporation in the heat-sensitive recording layer. Within the meaning of the present invention, polyvinyl alcohol, ethylene vinyl alcohol copolymers, or polyvinyl alcohol in combination with ethylene vinyl alcohol copolymers are particularly preferred binders which are incorporated together in the heat-sensitive recording layer in a range of 10 to 20 percent by weight based on the total weight of the recording layer.

To prevent sticking to a thermal head and to prevent excessive wear of the thermal head, the coating composition for forming the heat-sensitive recording layer—in general and within the first and second preferred embodiment forms relating to the heat-sensitive recording layer—can also contain lubricants and release agents such as metal salts of higher fatty acids, for example, zinc stearate, calcium stearate, and waxes such as, e.g., paraffin, oxidized paraffin, polyethylene, polyethylene oxide, stearic acid amide, and castor wax. Other possible constituents of the recording layer are, for example, pigments, preferably inorganic pigments such as, for example, aluminum (hydr)oxide, silicic acid, and calcium carbonate. Calcium carbonate which is preferably incorporated in the recording layer in a quantity of from 0 to 28 percent by weight based on the total weight of the recording layer is preferred.

Generally and within the first and second preferred embodiments relating to the heat-sensitive recording layer, roll doctor coating units, knife coating units, curtain coaters, or air brushes can be used in particular as coating devices for applying the heat-sensitive recording layer. According to a preferred embodiment, the coating composition used to form the recording layer is aqueous. The subsequent drying of the coating composition is usually carried out by a process in which heat is supplied such as by hot air floatation dryers or contact dryers. A combination of the aforementioned drying methods has also proven successful. The basis weight of the heat-sensitive recording layer is preferably between 2 $g/m^2$ and 6 $g/m^2$ or, better still, between 2.2 $g/m^2$ and 4.8 $g/m^2$.

In a particularly preferred embodiment, the heat-sensitive recording material according to the invention has a pigment-containing intermediate layer arranged between the barrier coating and the heat-sensitive recording layer.

The pigments of the intermediate layer can be organic hollow pigments as well as inorganic pigments, the latter preferably being selected from the group comprising both natural and calcined kaolin, silicon oxide and, in particular, bentonite, calcium carbonate and aluminum hydroxide, particularly boehmite. On one hand, an intermediate layer of this type can contribute in a positive manner to the leveling of the surface to be coated so that the required amount of coating composition to be applied for the heat-sensitive recording layer is reduced. For this reason, leveling coating devices such as, e.g., roller coating units, knife coating units, and (roll) doctor coating units are suitable for applying the pigmented intermediate layer. On the other hand, the pigments of this intermediate layer can absorb the wax constituents of the heat-sensitive recording layer which are liquefied by the heating effect during formation of the print image and accordingly promote a more reliable and faster functioning of the heat-induced recording. The basis weight of the pigment-containing intermediate layer is preferably between 5 $g/m^2$ and 20 $g/m^2$ or, even better, between 7 $g/m^2$ and 11 $g/m^2$.

Without limiting to paper as substrate, paper is the substrate which has established itself commercially and which is preferred within the meaning of the invention and with regard to those tinctures causing a change in opacity of a paper substrate. However, because of the arrangement of the barrier coating between the substrate and the heat-sensitive recording layer, it is also possible to use substrates which would ordinarily be out of the question because of their ingredients and the negative influence thereof on the heat-sensitive recording layer, for example, foils or foil-coated papers, where the respective foils contain larger amounts of plasticizers, or papers made from recycled fibers of the poorest quality.

The authenticating security feature according to the invention preferably takes the form of an imitation watermark which is applied to at least one side of the substrate. It is particularly preferable that these imitation watermarks are generated from tinctures produced optionally or in combination with one another:

based on glycerol, oils or fats based on organic solvents, based on polymers, e.g., polyurethanes.

Within the framework of a first preferred alternative embodiment for the authenticating security feature, the proposed heat-sensitive recording material has a coating which is made from a tincture, where the tincture comprises at least one organic solvent, and which is applied to the front or, particularly preferably, to the back of the substrate in the form of at least one mark or in the form of a pattern. It is also possible that the tincture comprises a mixture of a plurality of organic solvents. In a preferred embodiment form, other constituents such as, e.g., fluorescent fibers and/or pigments are also contained in the tincture.

The application of the tincture having at least one organic solvent to the substrate made of paper for forming the authentication feature causes a change in the opacity or in the transparency of the substrate at the locations wetted with the tincture compared to the locations on the substrate not wetted with the tincture. When the heat-sensitive recording material which is proposed herein and treated in this way is held against a light source, the change in transparency when looking through it appears in a sharp-edged manner as an easily discernible image or pattern.

Analog printing methods such as flexographic and intaglio printing methods are particularly suitable for applying the tincture forming the authentication feature. In a particularly preferred embodiment, the tincture is applied by means of digital printing methods. When the tincture is applied by digital printing technology, which is preferred and is afforded by inkjet printing methods among others, it is possible to form an individual authentication feature for each individual portion of the heat-sensitive recording material proposed herein. When the heat-sensitive recording material proposed herein is used as a ticket and/or in particular as an admission ticket, each individual admission ticket can be provided with an individual authentication feature. In case of an admission ticket for a soccer match, for example, the promoter, venue, game time, opposing soccer teams, place and time of purchase of the ticket, and perhaps also a consecutive control number as individual authentication feature can be formed on the heat-sensitive recording material proposed herein. Counterfeiting of an authentication feature of this kind is difficult and, given a corresponding check at the event location, is futile.

Within the framework of a second preferred alternative embodiment for the authenticating security feature, the proposed heat-sensitive recording material has a coating made from a tincture which is applied in the form of at least one mark or in the form of a pattern optionally and in both cases particularly preferably to the front or back of the substrate by means of flexographic printing or offset printing, wherein the tincture is polyurethane-based and can optionally, and also in a possible equally preferred embodiment form, have free isocyanate groups. When applied to the paper-like and/or fiber-containing substrate, tinctures of the kind envisaged within the framework of this second alternative embodiment for the security feature within the framework of the present application cause a change in the opacity or in the transparency of the substrate at the locations wetted with the tincture compared to the locations on the substrate not wetted with the tincture. When the heat-sensitive recording material which is treated in this way and which is proposed herein within the framework of this second alternative embodiment is held against a light source, the change in transparency when looking through it appears in a sharp-edged manner as an easily discernible image or pattern.

For examples of the polyurethane-based tinctures envisaged herein, reference is made to WO 2008/009 388 A1 and all of the compositions claimed therein according to patent claims 1 to 32, and also to the more recent WO 2008/135 273 A1 and all of the compositions claimed therein corresponding to patent claims 18 to 27. The content of both, WO 2008/009388 A1 and WO 2008/135273 A1, are incorporated herein of reference in their entirety. The compositions claimed in the above documents represent particularly preferred alternative embodiments of the tinctures within the meaning of the second preferred alternative embodiments for the recording material according to the present invention.

Accordingly, pursuant to the preceding statements, it is particularly preferred that the heat-sensitive recording material proposed herein is used as a ticket, particularly preferably as an admission ticket.

The invention will be explained further with reference to the following examples 1, 4 and 7 according to the invention and comparison examples 2, 3 and 5,6.

For this purpose, a paper web of bleached, ground hardwood and softwood pulps with a basis weight of 130 g/m$^2$ and with the addition of common additives in conventional amounts is first produced on a Fourdrinier paper machine as substrate. Three sample rolls are cut out of the paper web for further processing.

For example 1 according to the invention and the two comparison examples 2 and 3, three different coating compositions are prepared for applying a barrier coating to the front of the respective substrate of the three sample rolls:

Coating composition BS1 (for example 1) contains up to 99.5 percent by weight of ethylene vinyl alcohol copolymer (EVOH), more precisely Exceval HR 3010 (Kuraray), further constituents of coating composition BS 1 are primarily defoaming agents.

Coating composition BS2 (for comparison example 2) contains up to 99.5 percent by weight of common polyvinyl alcohol, more precisely Gohsenol NM 11 (Nippon Gohsei), further constituents of coating composition BS2 are primarily defoaming agents.

Coating composition BS3 (for comparison example 3) contains up to 99.5 percent by weight of silanized polyvinyl alcohol, more precisely R 1130 (Kuraray), further constituents of coating composition BS3 are primarily defoaming agents.

The three coating compositions are diluted with water to a solids content of 12% for the intended application by air brush. The respective viscosities of the coating compositions are then determined on a Brookfield viscosimeter (spindle 3, 100 rpm, 23° C.) resulting in the following measured values:

coating composition BS1: 750, coating composition BS2: 690, coating composition BS3: 2780 (fractionization, no possibility of even coating).

For example 1 according to the invention and the two comparison examples 2 and 3, the three coating compositions are now applied by air brush to the front side of the respective substrate of the three sample rolls with a respective basis weight of 2.8 g/m$^2$.

With all three sample rolls, there are applied to the dried barrier coating within one pass through the multi-head coating machine being used:

an intermediate layer of 8 g/m$^2$ having primarily calcined kaolin and organic hollow pigments as pigment mixture, styrene-butadiene latex as binder, and starch as co-binder by means of a roll doctor coater and, subsequently, a heat-sensitive recording layer having a basis weight of 4.2 g/m$^2$ by means of a roll doctor coating device.

The coating composition used for the heat-sensitive recording layer essentially contains the following components:

dye precursor: 3-dibutylamino-6-methyl-7-anilinofluoran, i.e., ODB-2;

color acceptor: N-(p-toluenesulphonyl)-N'-3-(p-toluenesulphonyl-oxyphenyl)urea, i.e., Pergafast® 201;

sensitizer: benzyl naphthyl ether, i.e., BNE;

binder: polyvinyl alcohol;

co-binder: acrylate copolymer;

pigment: calcium carbonate.

Finally, in all three sample rolls, a protective layer of 2.0 g/m$^2$ is applied to the heat-sensitive recording layer by air brush. A coating composition essentially containing the following components is used for this purpose:

binder: diacetone-modified polyvinyl alcohol; 61.3 percent by weight (oven dry)

cross-linking agent: adipic acid dihydrazide; 6.0 percent by weight (oven dry)

pigment: kaolin; 16.6 percent by weight (oven dry)

slipping agent: Hidorin Z-7-30; 8.1 percent by weight (oven dry)

additives: pH control agents, optical brighteners; 8.0 percent by weight (oven dry)

In the case of all three sample rolls, the desired barrier effect of the barrier layer against organic solvents is then analyzed. To this end, 0.5 ml of ethanol is added with a pipette to the back of test strips from the three sample rolls corresponding to example 1 according to the invention and the two comparison examples 2 and 3. The ethanol is left to act for a period of 10 minutes and is then completely removed by suction. The effect of applying solvent to the heat-sensitive recording layer is assessed visually.

The heat-sensitive recording layer of example 1 according to the invention shows no thermal reactions; the excellent quality of the present invention is confirmed. In comparison example 2, there is an intense thermal reaction; this barrier coating is not at all suited to develop an extensive protective action against organic solvents from the direction of the substrate over an extended application time. In comparison example 3, there are scattered color reaction spots on the heat-sensitive recording layer: the barrier coating composed of coating composition BS3 presents cracks and flaws beneath these color spots due to the excessive viscosity of the silanized polyvinyl alcohol. In this case also, the barrier effect against organic solvents is not conclusive due to the presence of flaws.

For examples 4 and 7 according to the invention and comparison examples 5 and 6, a paper web of bleached, ground hardwood and softwood pulps with a basis weight of 90 g/m$^2$ and with the addition of common additives in conventional amounts is produced on a Fourdrinier paper machine as substrate. Four sample rolls are cut out of the paper web for further processing.

For example 4 according to the invention, a barrier coating of 3.5 g/m$^2$ comprising coating composition BS1—also used in example 1 according to the invention—which is diluted with water to a solids content of 12.1% is applied to the front side of this substrate by air brush.

There are once again applied to the dried barrier coating:

an intermediate layer of 8 g/m$^2$ having primarily calcined kaolin and organic hollow pigments as pigment mixture, styrene-butadiene latex as binder, and starch as co-binder by means of a roll doctor coater and, subsequently, a heat-sensitive recording layer having a basis weight of 3.2 g/m$^2$ by means of a roll doctor coating device, wherein the same coating composition as that described in paragraph [0061] is used for the heat-sensitive recording layer.

Finally, a protective layer of 1.8 g/m$^2$ is applied to the heat-sensitive recording layer by air brush. The same coating composition as that described in paragraph [0062] is used for the protective layer.

For visual assessment of the barrier effect of the barrier layer, an imitation watermark in the form of lettering is printed by an offset printer on the back of the substrate of the sample roll corresponding to example 4 according to the invention which, as was already described, comprises the 90 $g/m^2$ substrate with barrier layer applied to the front side thereof, intermediate layer, recording material and protective layer; "Purintomark Transparent" by the Spanish company "Purinto Mark", Pasatge Maluquer, Barcelona, is used as printing ink. In addition, a four-color print image is applied to the front of the protective layer by the same offset printer used to print the imitation watermark on the back side. The sample roll which has been printed on both sides is rolled up again at the end of the printer.

While the imitation watermark in the form of lettering is easy to distinguish as a watermark when viewed from the protective layer side, this imitation watermark can only be discerned to some extent as an impression from the back, as is desirable. On the other hand, a thermal print image formed in the heat-sensitive recording layer by a thermal printer is also not impaired after 12 days at room temperature in the rolled up sample roll, which is an impressive confirmation of the full functionality of the barrier layer.

Comparison example 5 differs from example 4 according to the invention in that the barrier layer is omitted in comparison example 5. The arrangement in other respects and the subsequent printing are identical to the arrangement and printing of example 4 according to the invention. In assessing the applied imitation watermark, it is noted that the watermark is once again easily discernible from the protective layer side. The thermal print image formed in the heat-sensitive recording layer by the thermal printer has clearly faded after 12 days at room temperature in the rolled up sample roll at the locations of the watermark printed on the back.

Comparison example 6 differs from example 4 according to the invention in that, first, both barrier layer and protective layer are omitted in comparison example 6 and, second, the Pergafast® 201 in the heat-sensitive recording layer is replaced by bisphenol A. The arrangement in other respects and the subsequent printing are identical to the arrangement and printing of example 4 according to the invention. In assessing the applied imitation watermark, it is noted that the watermark is once again easily discernible from the protective layer side. The thermal print image formed in the heat-sensitive recording layer by the thermal printer fades instantly after being formed at the locations of the watermark printed on the back and is further worn away in the rolled up roll through contact with the layer of the paper web lying above it. In this case, it is barely possible to visually inspect the thermal print image after 12 days; it is obvious that a recording material of this kind is not suitable for forming an imitation watermark as claimed herein.

Example 7 according to the invention differs from example 4 according to the invention in that "Purintomark Yellow" by the Spanish company "Purinto Mark", Pasatge Maluquer, Barcelona, is used in example 7 according to the invention as printing ink for forming the imitation watermark. The arrangement in other respects and the subsequent printing are identical to the arrangement and printing of example 4 according to the invention. Whereas the imitation watermark in the form of the lettering employed is easily discernible as a watermark from the protective layer side, this imitation watermark appears as a yellowish imprint from the back. Once again, a thermal print image formed in the heat-sensitive recording layer by a thermal printer is also not impaired after 12 days at room temperature in the rolled up sample roll, which, in this case again, is an impressive confirmation of the full functionality of the barrier layer.

This confirms the superiority of the proposed heat-sensitive recording material ultimately expected by the inventors.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material comprising:

a substrate, a heat-sensitive recording layer arranged on the front side of the substrate including at least one dye precursor and at least one color acceptor, said dye precursor and color acceptor reacting with one another under the action of heat to form color, a protective layer covering said heat-sensitive recording layer, a barrier coating comprising ethylene vinyl alcohol copolymer (EVOH) for protecting said heat-sensitive recording layer against penetration of chemicals causing uncontrolled desensitizing reactions and color reactions in said heat-sensitive recording layer, said barrier coating being arranged between said substrate and said heat-sensitive recording layer, and a tincture, as authenticating security feature, being one of introduced into said substrate and applied to at least one side of said substrate;

wherein said authenticating security feature is formed as a tincture based on one of at least glycerol, oils and fats applied to said substrate.

2. The heat-sensitive recording material according to claim 1, wherein said authenticating security feature is an imitation watermark applied to at least one side of said substrate.

3. The heat-sensitive recording material according to claim 1, wherein said authenticating security feature is formed as a tincture comprising at least an organic solvent applied to said substrate.

4. The heat-sensitive recording material according to claim 1, wherein said authenticating security feature is formed as a tincture based on at least polyurethane applied to said substrate.

5. The heat-sensitive recording material according to claim 1, wherein said barrier coating contains at least 90 percent by weight of said ethylene vinyl alcohol copolymer (EVOH) based on the total weight of said barrier coating.

6. The heat-sensitive recording material according to claim 1, wherein said barrier coating contains at least 98 percent by weight of said ethylene vinyl alcohol copolymer (EVOH) based on the total weight of said barrier coating.

7. The heat-sensitive recording material according to claim 1, wherein said protective layer comprises a cross-linking agent selected from the group comprising: boric acid, polyamine, epoxy resin, dialdehyde, formaldehyde oligomers, epichlorohydrin resin, adipic acid dihydrazide, dimethyl urea, melamine formaldehyde.

8. The heat-sensitive recording material according to claim 1, wherein said protective layer comprising an inorganic pigment selected from the group comprising: silicon dioxide, aluminum hydroxide, bentonite, calcium carbonate, kaolin, or a mixture of these inorganic pigments.

9. The heat-sensitive recording material according to claim 1, wherein said heat-sensitive recording layer contains as color acceptor at least one substance selected from the group comprising:

2,2-bis(4-hydroxyphenyl)propan,
4-[(4-(1-methylethoxy)phenyl)sulfonyl]phenol,
4,4'-dihydroxydiphenyl sulfone,
N-(p-toluenesulphonyl)-N'-3-(p-toluenesulphonyloxyphenyl)urea,
2,4'-dihydroxydiphenyl sulfone, and
N-(2-hydroxyphenyl)-2-[(4-hydroxyphenyl)thio]acetamide.

10. The heat-sensitive recording material according to claim 1, wherein said heat-sensitive recording layer has as dye precursor at least one substance selected from the group comprising:

3-diethylamino-6-methyl-7-anilinofluoran,
3-dibutylamino-6-methyl-7-anilinofluoran,
3-(N-methyl-N-propyl)amino-6-methyl-7-anilinofluoran,
3-(N-ethyl-N-isoamyl)amino-6-methyl-7-anilinofluoran,
3-(N-methyl-N-cyclohexyl)amino-6-methyl-7-anilinofluoran,
3-(N-ethyl-N-tolyl)amino-6-methyl-7-anilinofluoran, and
3-(N-ethyl-N-tetrahydrofuryl)amino-6-methyl-7-anilinofluoran.

11. The heat-sensitive recording material according to claim 1, wherein said heat-sensitive recording layer comprises at least one sensitizer selected from the group comprising methylolstearoamide, stearic acid amide, and dimethyl terephtalate.

12. The heat-sensitive recording material according to claim 1, wherein heat-sensitive recording layer comprises as binder a substance selected from the group comprising: polyvinyl alcohol, ethylene vinyl alcohol copolymer, or a combination of polyvinyl alcohol and ethylene vinyl alcohol copolymer.

13. The heat-sensitive recording material according to claim 1, wherein said heat-sensitive recording layer additionally comprises a pigment-containing intermediate layer arranged between said barrier coating and said heat-sensitive recording layer.

14. A heat-sensitive recording material comprising:

a substrate, a heat-sensitive recording layer arranged on the front side of the substrate including at least one dye precursor and at least one color acceptor, said dye precursor and color acceptor reacting with one another under the action of heat to form color, a protective layer covering said heat-sensitive recording layer, a barrier coating comprising ethylene vinyl alcohol copolymer (EVOH) for protecting said heat-sensitive recording layer against penetration of chemicals causing uncontrolled desensitizing reactions and color reactions in said heat-sensitive recording layer, said barrier coating being arranged between said substrate and said heat-sensitive recording layer, and a tincture, as authenticating security feature, being one of introduced into said substrate and applied to at least one side of said substrate;

wherein said protective layer comprises as binder at least 60 percent by weight of diacetone-modified polyvinyl alcohol based on the total binder component in said protective layer.

15. A heat-sensitive recording material comprising:

a substrate, a heat-sensitive recording layer arranged on the front side of the substrate including at least one dye precursor and at least one color acceptor, said dye precursor and color acceptor reacting with one another under the action of heat to form color, a protective layer covering said heat-sensitive recording layer, a barrier coating comprising ethylene vinyl alcohol copolymer (EVOH) for protecting said heat-sensitive recording layer against penetration of chemicals causing uncontrolled desensitizing reactions and color reactions in said heat-sensitive recording layer, said barrier coating being arranged between said substrate and said heat-sensitive recording layer, and a tincture, as authenticating security feature, being one of introduced into said substrate and applied to at least one side of said substrate;

wherein said protective layer comprises as binder exclusively diacetone-modified polyvinyl alcohol.

16. A heat-sensitive recording material comprising:

a substrate, a heat-sensitive recording layer arranged on the front side of the substrate including at least one dye precursor and at least one color acceptor, said dye precursor and color acceptor reacting with one another under the action of heat to form color, a protective layer covering said heat-sensitive recording layer, a barrier coating comprising ethylene vinyl alcohol copolymer (EVOH) for protecting said heat-sensitive recording layer against penetration of chemicals causing uncontrolled desensitizing reactions and color reactions in said heat-sensitive recording layer, said barrier coating being arranged between said substrate and said heat-sensitive recording layer, and a tincture, as authenticating security feature, being one of introduced into said substrate and applied to at least one side of said substrate;

wherein the ratio of weight percent of diacetone-modified polyvinyl alcohol to cross-linking agent is in a range of 20:1 to 5:1.

17. A heat-sensitive recording material comprising:

a substrate, a heat-sensitive recording layer arranged on the front side of the substrate including at least one dye precursor and at least one color acceptor, said dye precursor and color acceptor reacting with one another under the action of heat to form color, a protective layer covering said heat-sensitive recording layer, a barrier coating comprising ethylene vinyl alcohol copolymer (EVOH) for protecting said heat-sensitive recording layer against penetration of chemicals causing uncontrolled desensitizing reactions and color reactions in said heat-sensitive recording layer, said barrier coating being arranged between said substrate and said heat-sensitive recording layer, and a tincture, as authenticating security feature, being one of introduced into said substrate and applied to at least one side of said substrate;

wherein the ratio of weight percent of diacetone-modified polyvinyl alcohol to cross-linking agent is in a range of 12:1 to 7:1.

* * * * *